US007360266B2

(12) United States Patent
Kasatshko

(10) Patent No.: US 7,360,266 B2
(45) Date of Patent: Apr. 22, 2008

(54) MULTIPLE POSITION AIR MATTRESS SYSTEM

(76) Inventor: Victor M. Kasatshko, 1155 Dartford Dr., Tarpon Springs, FL (US) 34688

( * ) Notice: Subject to any disclaimer, the term of this patent is extended or adjusted under 35 U.S.C. 154(b) by 289 days.

(21) Appl. No.: 11/209,936

(22) Filed: Aug. 23, 2005

(65) Prior Publication Data

US 2005/0278861 A1 Dec. 22, 2005

Related U.S. Application Data

(63) Continuation-in-part of application No. 11/079,939, filed on Mar. 14, 2005, now Pat. No. 7,231,681, which is a continuation-in-part of application No. 10/744,874, filed on Dec. 23, 2003, now Pat. No. 6,886,204, which is a continuation-in-part of application No. 10/350,587, filed on Jan. 24, 2003, now abandoned.

(51) Int. Cl.
*A47C 20/04* (2006.01)

(52) U.S. Cl. ..... 5/722; 5/733; 5/633; 5/710; 297/452.41

(58) Field of Classification Search ..... 5/731–734, 5/710, 722, 615, 632–634; 297/250.1, 452.41
See application file for complete search history.

(56) References Cited

U.S. PATENT DOCUMENTS

| | | | |
|---|---|---|---|
| 1,976,320 | A | 10/1934 | Austin |
| 2,623,574 | A | 12/1952 | Damnsch |
| 3,029,109 | A | 4/1962 | Nail |
| 3,286,285 | A | 11/1966 | Harvey, Jr. |
| 3,308,489 | A | 3/1967 | Winkler |
| 3,572,836 | A | 3/1971 | Khanh |
| 3,606,623 | A | 9/1971 | Aymar |

(Continued)

OTHER PUBLICATIONS

Web page from www.selectcomfort.com, Sep. 9, 2005.

(Continued)

*Primary Examiner*—Michael Trettel
(74) *Attorney, Agent, or Firm*—Gordon & Jacobson, PC

(57) ABSTRACT

A multiple position air mattress system for achieving various support positions includes a first mattress, a second mattress, and a bellows unit attached to the second mattress. The bellows unit is extendable for either elevating the second mattress or providing a support for an individual. The multiple position air mattress system can assume a prone bed position with the mattresses longitudinally adjacent each other and the bellows unit deflated and an inclined bed position with the mattresses longitudinally adjacent each other and the bellows unit inflated under the second mattress. In the inclined bed position, the degree of elevation of the second mattress can be finely adjusted by increasing or decreasing the inflation level of the bellows unit. A fourth inflatable member may be positioned on the top side of the second mattress to support the lumbar section of the user's body. A fifth inflatable member may be positioned under the user's leg to provide adjustable elevation of the legs. A sixth inflatable member may be positioned on the top side of the second mattress to support the user's neck. A pump unit including a plurality of ports and a corresponding plurality of hoses are coupled to inflatable members to provide for independent inflation thereof. A control unit is operably coupled to the pump unit to provide for independent control of the inflation levels of the members. Preferably, a cover substantially encloses the tops, bottoms and sides of the members. Foam inserts may surround at least three sides of the perimeter of the first and/or second mattresses.

43 Claims, 8 Drawing Sheets

U.S. PATENT DOCUMENTS 3,740,095 A 6/1973 Nall
3,740,774 A 6/1973 Powell
3,742,526 A 7/1973 Lillard
3,751,739 A 8/1973 Assmann
3,890,658 A 6/1975 Petersilie
3,902,759 A 9/1975 Monteforte et al.
3,959,835 A 6/1976 Nos
3,978,530 A * 9/1976 Amarantos ..... 5/615
4,153,958 A 5/1979 Paulik
4,173,045 A 11/1979 Osborn
4,175,297 A 11/1979 Robbins et al.
4,207,633 A 6/1980 Smith et al.
4,459,714 A 7/1984 Lin
4,518,203 A 5/1985 White
4,527,298 A 7/1985 Moulton
4,639,960 A 2/1987 Quillen et al.
4,685,163 A * 8/1987 Quillen et al. ..... 5/710
4,829,614 A 5/1989 Harper
4,836,605 A 6/1989 Greenwood et al.
4,839,932 A 6/1989 Williamson
4,873,731 A 10/1989 Williamson
4,890,344 A 1/1990 Walker
4,905,332 A 3/1990 Wang
4,941,221 A 7/1990 Kanzler
4,991,244 A 2/1991 Walker
4,998,310 A * 3/1991 Olson ..... 5/710
5,058,225 A 10/1991 Annand
5,170,522 A 12/1992 Walker
5,267,363 A 12/1993 Chafee
5,311,625 A 5/1994 Barker et al.
5,335,968 A 8/1994 Sheridan et al.
5,345,630 A 9/1994 Healy
5,367,726 A 11/1994 Chafee
5,439,405 A 8/1995 Storey et al.
5,506,012 A 4/1996 Wright et al.
5,516,188 A 5/1996 Bruhnke et al.
5,560,056 A 10/1996 Tai
5,566,409 A 10/1996 Klearman
5,577,278 A * 11/1996 Barker et al. ..... 5/615
5,699,569 A 12/1997 Schwarz-Zohrer
5,765,246 A 6/1998 Shoenhair
5,787,531 A 8/1998 Pepe
5,806,115 A 9/1998 Brown
5,809,597 A 9/1998 Shaw
D406,870 S 3/1999 Bauman
5,881,407 A 3/1999 Chu Pt
5,963,997 A 10/1999 Hagopian
5,966,762 A * 10/1999 Wu ..... 5/710
5,970,545 A 10/1999 Garman et al.
6,012,186 A 1/2000 Soltani et al.
6,042,186 A 3/2000 Kojic et al.
6,058,538 A 5/2000 Chapman et al.
D434,243 S 11/2000 Casto et al.
6,224,444 B1 5/2001 Klimenko
6,397,419 B1 6/2002 Mechache
6,499,166 B1 12/2002 Jones
6,739,005 B2 * 5/2004 Davis ..... 5/615
6,848,137 B1 * 2/2005 Barnes ..... 5/710
6,886,204 B2 5/2005 Kasatshko et al.
6,981,287 B1 * 1/2006 Chen ..... 5/634
2005/0099054 A1 5/2005 McCarthy

OTHER PUBLICATIONS

Web pages from www.nautilussleepsystems.com Mar. 22, 2005.
Advertisement for UK Airbeds, Airmats, Air Mattresses, Lilos For traveling, camping, pool, beach and seaside.
"The Sleep Number Bed by Select Comfort™", available at http://selectcomfort.com/beds/indexc.cfm?proc=1&cmref=homeside.

* cited by examiner

MULTIPLE POSITION AIR MATTRESS SYSTEM

CROSS REFERENCE TO RELATED APPLICATIONS

The present application is a continuation-in-part of U.S. patent application Ser. No. 11/079,939, filed Mar. 14, 2005, now U.S. Pat. No. 7,231,681, which in turn is a continuation-in-part of U.S. patent application Ser. No. 10/744,874, filed Dec. 23, 2003, now U.S. Pat. No. 6,886,204, which in turn is a continuation-in-part of U.S. patent application Ser. No. 10/350,587, filed Jan. 24, 2003, now abandoned, all of which are herein incorporated by reference in their entireties.

BACKGROUND OF THE INVENTION

1. Field of the Invention

The present invention relates generally to air mattresses and more specifically it relates to a multiple position air mattress system for achieving various support positions.

2. Description of the Related Art

Air mattresses have been in use for years. A conventional air mattress is comprised of a rectangular flat structure that is inflatable forming a bed-like structure. Conventional air mattresses may have pumps built into them or may be inflated from an external air source. Conventional air mattresses are not capable of being positioned in more than a prone bed position. The present invention overcomes the inherent limitations contained within conventional air mattresses.

SUMMARY OF THE INVENTION

In view of the foregoing disadvantages inherent in the known types of air mattresses now present in the prior art, the present invention provides a new multiple position air mattress system construction, which can be utilized for achieving various support positions and support functions.

The general purpose of the present invention, which will be described subsequently in greater detail, is to provide a new multiple position air mattress system that has many of the advantages of the air mattresses mentioned heretofore and many additional features that result in a new multiple position air mattress system.

Thus, a primary object of the present invention is to provide a multiple position air mattress system that will overcome the shortcomings of the prior art devices.

Another object is to provide a multiple position air mattress system for achieving various support positions.

A further object is to provide a multiple position air mattress system that may form into various positions such as but not limited to a prone bed and an inclined bed.

An additional object is to provide a multiple position air mattress system that is efficient and easy to utilize.

A further object is to provide a multiple position air mattress system that may be stored in a compact storage position.

In accord with these objects, the present invention generally comprises a multiple position air mattress system including a first inflatable member, a second inflatable member, a hinge pivotally connecting the second inflatable member and the first inflatable member, and a third inflatable member attached to the second inflatable member. The third inflatable member is disposed below the second inflatable member. The inflation level of the third inflatable member is adaptable such that, when it is substantially deflated, the air mattress system is positioned in a prone bed position; and, when it is inflated, the second inflatable member pivots relative to the first inflatable member and the air mattress system is positioned in an inclined bed position. The degree of elevation of the second inflatable member (i.e., the pivot angle of the second inflatable member relative to the first inflatable member) can be finely adjusted by increasing or decreasing the inflation level of the third inflatable member. In the prone bed position, the pressure/comfort levels of the first and second inflatable members are controlled independently. In the inclined bed position, the inflation level of the third inflatable member can be adjusted to control the inclination of the user's upper body. The first, second and third inflatable members are independently inflatable. A pump unit including a plurality of ports and a corresponding plurality of hoses are coupled to the first, second and third inflatable members to provide for independent inflation of the members. A control unit is operably coupled to the pump unit to provide for independent control of the inflation levels of the first, second and third inflatable members.

In an alternative embodiment, the air mattress system may include a fourth inflatable member that is positioned on the top side of the second inflatable member in the area near the hinge and supports the lumbar section of the user's body. The first inflatable member may be partitioned into multiple sections that are spaced apart along its length and pivotally joined together by one or more hinges. At least one of these sections is positioned under the user's legs. A fifth inflatable member is positioned under this at least one section to provide for adjustable elevation of the legs. A sixth inflatable member may be positioned on the top side of the second inflatable member in an area that supports the user's neck. The fourth inflatable member, fifth inflatable member, and/or the sixth inflatable member are independently inflatable. The pump unit is adapted to include an additional port(s) and hose(s) that are coupled to the respective fourth, fifth and/or sixth inflatable members to provide for independent inflation thereof. The fourth inflatable member (which provides lumbar support) may be inflated to different pressure/comfort levels independently of the pressure/comfort levels of the first and second inflatable members. The fifth inflatable members may be inclined to different inflation levels, independent of the pressure levels of the first and second inflatable members, to control the elevation of the user's legs. Such elevation control provides relief for swelling of the legs as well as for circulatory ailments of the legs (e.g., varicose veins). The sixth inflatable member (which provides neck support) may be inflated to different pressure/comfort levels independently of the pressure/comfort levels of the first and second inflatable members.

Preferably, a cover substantially (or fully) encloses the tops, bottoms and sides of the inflatable members of the air mattress system. The top, bottom and sides of the cover are preferably quilted. The top of the cover (i.e., the portion that overlies the top surfaces of the first, second and possibly the fourth and/or sixth inflatable members and that contacts the user's body) is preferably thick and plush to provide added comfort, and may incorporate fillings such as down feathers, latex foam, memory foam, cellulose, etc. The bottom of the cover is preferably realized from a thin quilted material, which encloses the bottom of the first, third and possibly fifth inflatable members completely.

Foam members may surround at least three sides of the perimeter of the first inflatable member and/or the second inflatable member. The height of the foam members lies below the full height of the respective member, thus providing air support over 100 percent of the top surface of the air mattresses system. The foam members also aid against the user "bottoming out" when sitting on the edge of the air mattress system.

In yet another embodiment of the invention, two air mattress systems as described herein can be arranged in a side-by-side manner to provide a large air mattress structure (e.g., queen or king size arrangement), with the inflation levels of each particular side being independently controllable in accordance with the desired pressure/comfort levels and positioning (e.g., degree of upper body inclination and leg elevation) of the user of the particular side.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

Other objects and advantages of the present invention will become apparent to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

In the drawings, like reference characters designate the same or similar parts throughout the several views.

DETAILED DESCRIPTION OF THE INVENTION

A. Overview

Figure 1:
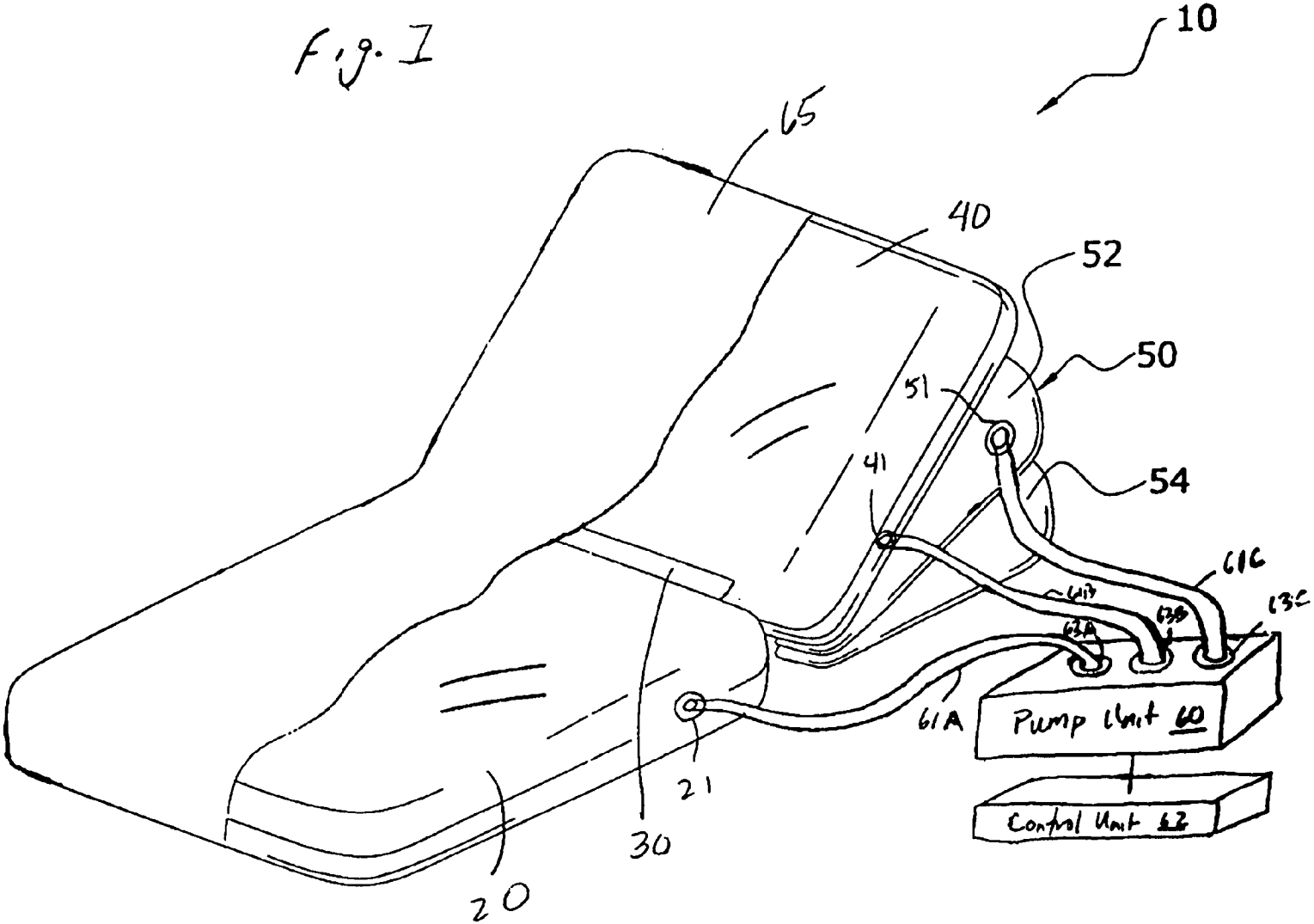
FIG. 1 is a perspective partial cut-away view of a multi-position air mattress system in accordance with the present invention, which is configured in an inclined bed position.
Figure 2:
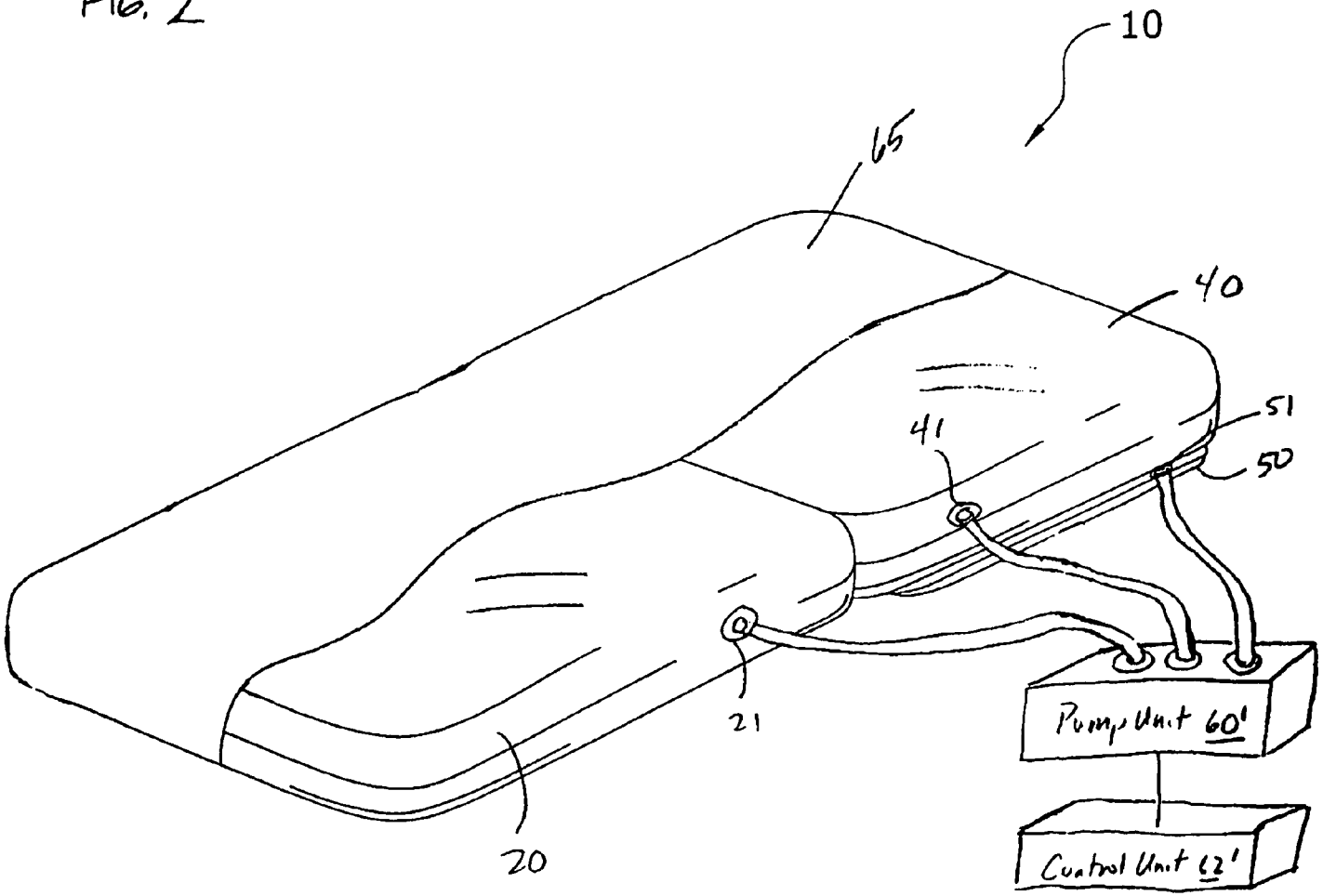
FIG. 2 is a perspective partial cut-away view of the multi-position air mattress system of FIG. 1, which is configured in a prone bed position.
Figure 3:
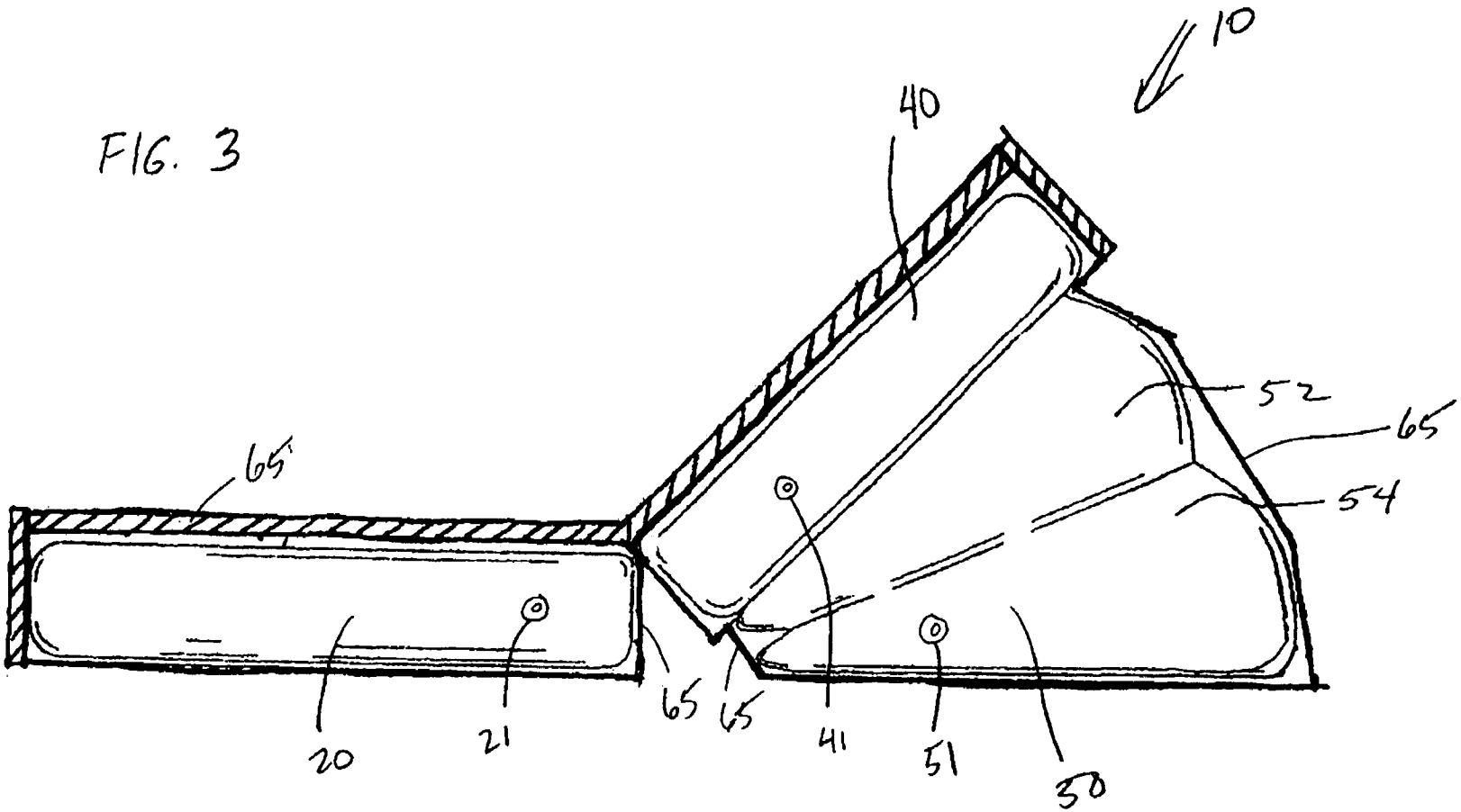
FIG. 3 is a cross-sectional view of the multi-position air mattress system of FIG. 1.

Turning now descriptively to the drawings, in which similar reference characters denote similar elements throughout the several views, FIGS. 1 through 3 illustrate a multiple position air mattress system 10, which comprises a first mattress 20, a second mattress 40 connected to the first mattress 20 by a hinge member 30, and a bellows unit 50 attached to the second mattress 40. A cover 65 substantially encloses the inflatable members 20, 40, 50. Each of the first mattress 20, the second mattress 40, and the bellows unit 50 is preferably provided with a respective air intake/outlet coupler 21, 41, 51, for separately inflating or deflating that unit. A pump unit 60 is provided for providing pressurized air to the first mattress 20, the second mattress 40 and the bellows unit 50.

B. First Mattress

The first mattress 20 is inflatable via fluid coupling means 21 and may be comprised of various inflatable structures and shapes. The first mattress 20 is preferably comprised of reinforced PVC, reinforced rubber or other suitable material(s) capable of retaining pressurized air within. In addition, the first mattress may have internal webs or beams that couple the top and bottom surfaces of the mattress 20. The beams may extend along directions that are parallel to the longitudinal axis of the first mattress 20 and/or may extend along directions transverse thereto. Alternatively, other support structure(s), such as a series of cylindrical or otherwise shaped columns that couple the top and bottom surfaces of the mattress, may be used. The first mattress 20 may also be coated or covered with various types of materials such as flocking, cotton, flannel, polyester, rayon, etc. The first mattress may further be provided with one or more slots or holes (not shown) on either side of the mattress so that the mattress may be coupled by a belt or other coupling means to a similar first mattress, when the mattress system is used as part of larger inflatable mattress structure (e.g., a queen-sized or king-sized bed arrangement) as described below.

C. Second Mattress

The second mattress 40 is inflatable via fluid coupling means 41 and may be comprised of various inflatable structures and shapes similar to the first mattress 20. The second mattress 40 is preferably comprised of reinforced PVC, reinforced rubber or other suitable material(s) capable of retaining pressurized air within. In addition, the second mattress 40 may have internal webs or beams that couple the top and bottom surfaces of the mattress 40. The beams may extend along directions that are parallel to the longitudinal axis of the second mattress 40 and/or may extend along directions transverse thereto. Alternatively, other support structure(s), such as a series of cylindrical or otherwise shaped columns that couple the top and bottom surfaces of the mattress, may be used. The second mattress 40 may also be coated or covered with various types of materials such as flocking. The second mattress 40 preferably shares the same dimensions and structure of the first mattress 20 as best illustrated in FIGS. 1 and 2.

The second mattress 40 is preferably pivotally connected via hinge member 30 to the first mattress 20 as best illustrated in FIGS. 1 and 3. The first mattress 20 and the second mattress 40 can be configured in a flat structure form as a prone bed as best illustrated in FIG. 2.

In the preferred embodiment of the invention, the first mattress 20 and the second mattress 40 are fluidly isolated from one another and thus inflated separately by the pressurized air source. This permits the first and second mattresses to be inflated to different pressure levels, which is desirable in providing desired support/comfort levels to different parts of the body. For example, because the human torso weighs considerably more than the legs, it may be desirable to inflate the second mattress to a higher degree than the first mattress (or vice versa), thereby providing more (or less) support to the torso.

D. Hinge Member

The hinge member 30 is attached between the first mattress 20 and the second mattress 40 for pivotally supporting the same as best illustrated in FIGS. 1 and 3. The hinge member 30 is preferably comprised of a flexible and flat piece of reinforced PVC, reinforced rubber, hook-and-loop fastener material, or other suitable material. The hinge member 30 is preferably heat sealed to both the first mattress 20 and the second mattress 40, and is preferably located near the top surfaces (i.e., the surface opposite the surface of the bellows) of the first and second mattresses so that the hinge member 30 fills the crack between the mattresses and provides a relatively continuous top surface for the system. Various other structures and configurations may be utilized to pivotally attach the first mattress 20 to the second mattress 40.

E. Bellows Unit

The bellows unit 50 is attached (possibly removably attached by hook and loop fasteners, straps or other detachable coupling means) to the second mattress 40 and is disposed under the second mattress 40 as illustrated in FIGS. 1 through 3. The bellows unit 50 may be comprised of one or more inflatable bellows as shown. FIGS. 1 through 3 illustrate the bellows unit 50 having a first bellows 52 attached to a lower side of the second mattress 40 and a second bellows 54 attached to the first bellows 52. The second bellows 54 is preferably fluidly connected to the first bellows 52 to allow for simultaneous or conditioned pressurization of the first bellows 52 and the second bellows 54 via fluid coupling means 51 from the pressurized air source. The bellows unit 50 is preferably comprised of reinforced PVC, reinforced rubber or other suitable material(s) capable of retaining pressurized air within. In addition, the bellows unit 50 may have internal webs or beams that couple the top and bottom surfaces of the unit 50. Alternatively, other support structure(s), such as a series of cylindrical or otherwise shaped columns that couple the top and bottom surfaces of the unit, may be used. The bellows unit 50 may also be coated or covered with various types of materials such as flocking, cotton, flannel, polyester, rayon, etc.

When inflated, the first bellows 52 and the second bellows 54 incline the second mattress 40 to a desired angle (preferably from zero degrees up to fifty degrees, and possibly from zero degrees up to sixty degrees) with respect to the first mattress 20 as best illustrated in FIGS. 1 and 3, thereby providing an inclined bed configuration. In the preferred embodiment of the invention, the first and second bellows 52, 54 are fluidly coupled to one another via a number of non-valved flow paths. The bellows 52, 54 receive pressurized air from the pressurized air source via fluid coupling means 51 such that they are inflated at substantially the same pressure. The extent of inflation of the bellows unit 50 is preferably controllable by the user.

Alternatively, if desired, the first bellows 52 and second bellows 54 may be inflated to different pressures. This feature may be controlled by a valved fluid coupling means (not shown) that fluidly couples the two bellows 52, 54, or by realizing the two bellows 52, 54 as two distinct air chambers that are pressurized independently from one another.

The shape and structure of the bellows unit 50 may be changed. For example, the bellows unit may include one or more air chambers that realize a wedge-shape structure when inflated. The inclined surface (or profile) of this wedge-shaped structure defines the adjustable inclination angle of the second mattress in the inclined bed position of the system as described herein.

F. Cover

A cover 65 substantially encloses the tops, bottoms and sides of the inflatable members 20, 40, 50. In the preferred embodiment, the top, bottom and sides of the cover 65 are quilted. The top of the cover 65 (i.e., the portion that overlies the top surfaces of the first and second mattresses 20, 40 and that contacts the user's body) is preferably thick and plush to provide added comfort, and may incorporate fillings such as down feathers, latex foam, memory foam, cellulose, etc. The bottom of the cover 65 is preferably realized from a thin quilted material which encloses the bottom of the first mattress 20 and the expandable bellows unit 50 completely. The material for the portion of the cover 65 that overlies the sides of the bellows unit 50 may be made of an expandable material. Alternatively, elastic straps may be provided to keep the material of the cover 65 that overlies the sides of the bellows unit 50 neat. The cover 65 may include one or more zippered or Velcro slots that allow the members 20, 40, 50 to be removed from within the cover 65. Finally, the cover 65 also preferably includes through-holes that provide access for coupling the hoses 61A, 61B, 61C to the respective members 20, 40, 50.

G. Pump Unit

In the preferred embodiment of the invention, the first mattress 20, the second mattress 40 and the bellows unit 50 are fluid coupled to the pump unit 60 via hoses 61A, 61B, 61C that are in fluid communication between the fluid coupling means 21, 41, 51 and respective ports 63A, 63B, 63C of the pump unit 60. The fluid coupling means 21, 41, 51 may be realized by valved or non-valved connectors or other suitable means. Preferably, the hoses 61A, 61B, 61C are detachably connected to the fluid coupling means 21, 41, 51 and/or are detachably connected to the ports 63A, 63B, 63C of the pump unit 60. The pump unit 60 may be comprised of any pump structure capable of providing pressurized air at independently controllable pressures to the first mattress 20, the second mattress 40 and the bellows unit 50 via the respective hose and fluid coupling means.

H. Control Unit

A control unit 62 is operably coupled to the pump unit 60, for example by a wired or wireless connection. The user interacts with the control unit 62 to control the operation of the pump unit 60 in supplying independent pressures to the first mattress 20, the second mattress 40 and the bellows unit 50.

I. Operation

The present invention preferably has two main positions: a prone bed position and an inclined bed position. In use, the three inflatable members 20, 40, 50 are enclosed within the cover 65, and the hoses 61A, 61B, 61C fluidly connect the pump unit 60 to the fluid coupling means 21, 41, 51 of the members 20, 40, 50. The user then determines which position is desired. For the prone bed position, the user lays the system upon a substantially flat surface and interacts with the control unit 62 to inflate the first mattress 20 and the second mattress 40 with the bellows unit 50 remaining deflated under the second mattress 40 as shown in FIG. 2. As previously indicated, the hinge 30 preferably fills the crack between the mattresses and provides a relatively continuous top surface for the system. The first and second mattresses 20, 40 may be inflated to different pressures to provide desired support/comfort levels for different parts of the body. For the inclined bed configuration, the user interacts with the control unit 62 to inflate the bellows unit 50 to a desired inclination angle for the second mattress 40 as illustrated in FIG. I and 3. The degree of inclination of the second mattress 40 (i.e., the pivot angle of the second mattress 40 relative to the first mattress 20) can be finely adjusted by increasing or decreasing the inflation level of the bellows unit 50. When the user desires to store or transport the present invention, a pressure relief valve or similar structure may be opened to release the air pressure within the first mattress 20, the second mattress 40 and the bellows unit 50, or the pump 60 may be used to vacuum air from the first mattress 20, the second mattress 40 and the bellows unit 50. One or more automatic pressure relief valves (not shown) may be provided in order to prevent structural failures (e.g., seam separation or bursting from sudden large loads).

J. First Alternative Embodiment

Figure 4:
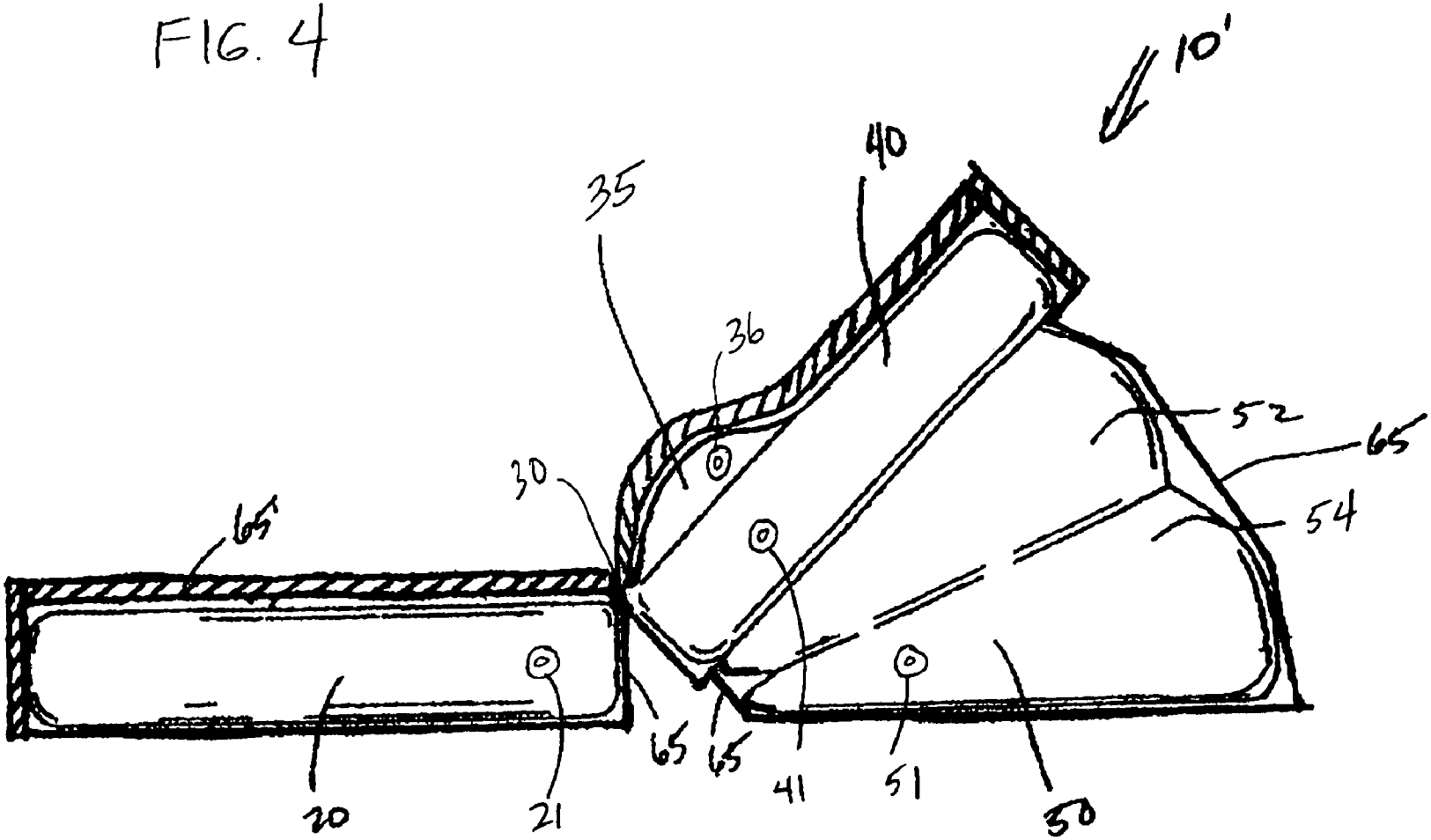
FIG. 4 is a cross-sectional view of another embodiment of a multi-position air mattress system in accordance with the present invention.
Figure 5A:
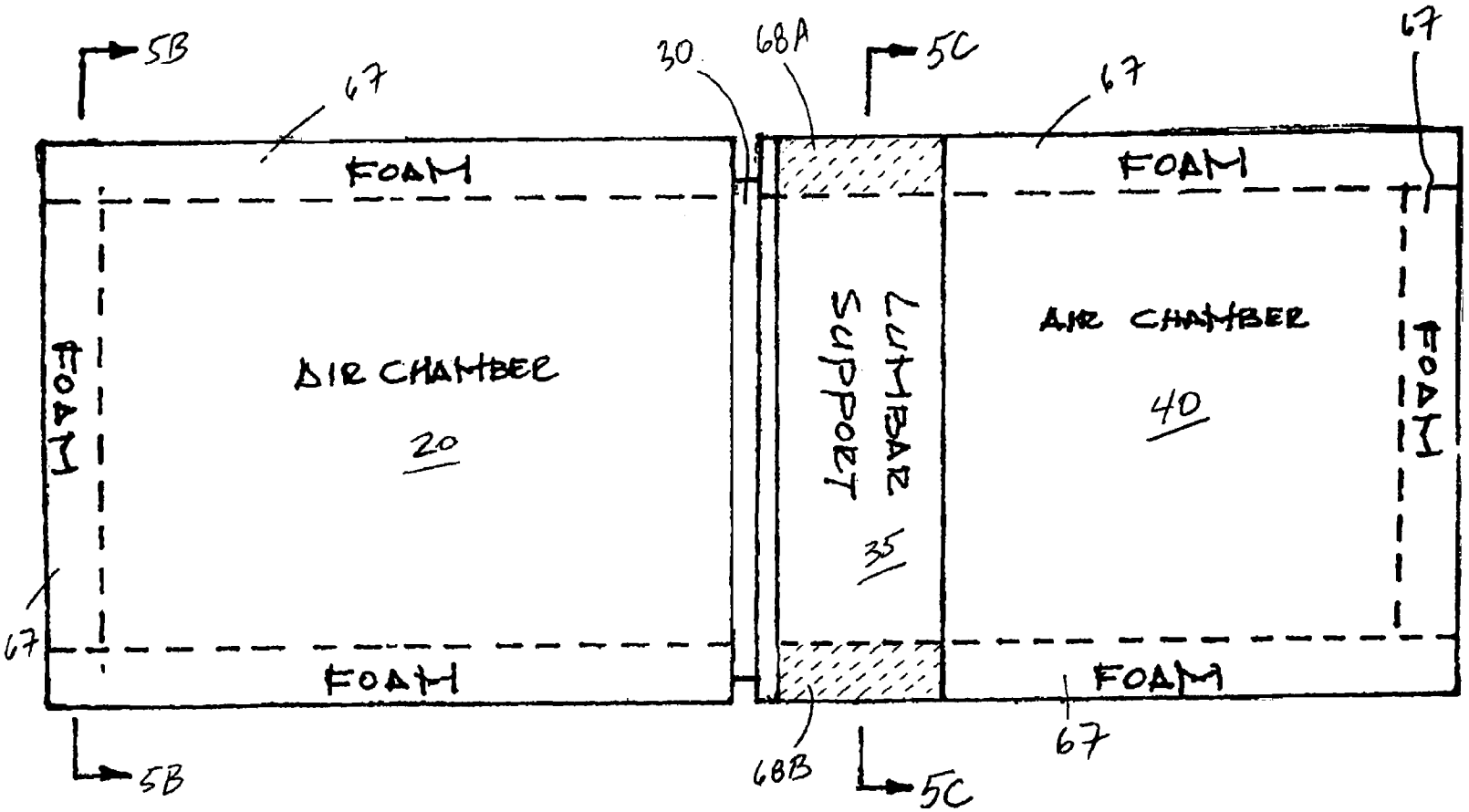
FIG. 5A is a schematic plan view of the multi-position air mattress system of FIG. 4.
Figure 5B:
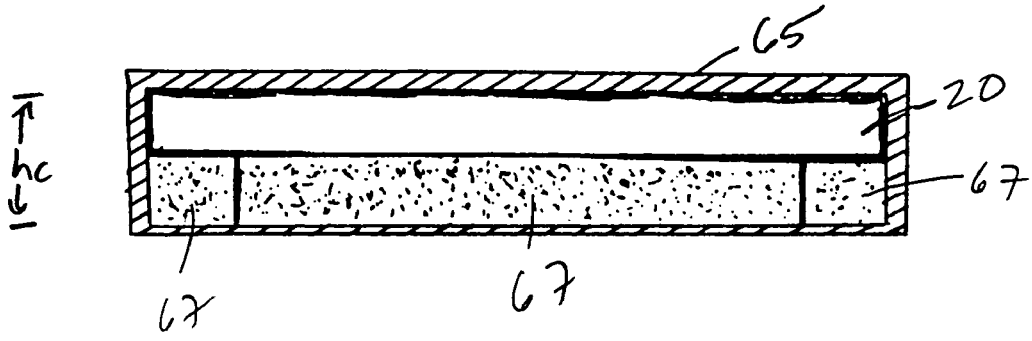
FIG. 5B is a schematic cross-sectional view of the multi-position air mattress system of FIG. 5A through line 5B-5B.

In an alternative embodiment as shown in FIGS. 4, 5A and 5B, the air mattress system 10' includes the first inflatable mattress 20, the second inflatable mattress 40, the bellows unit 50, and hinge 30 as described above. A fourth inflatable unit 35 is affixed to the top side of the second mattress 40 in the area near the hinge 30 and extends transverse to the lengthwise dimension of the mattress system. The fourth inflatable unit 35 supports the lumbar section of the user's body in both the prone bed position and the inclined position. The fourth unit 35 is preferably comprised of reinforced PVC, reinforced rubber or other suitable material(s) capable of retaining pressurized air within. In addition, the fourth unit 35 may have internal webs or beams that couple the top and bottom surfaces of the unit 35. Alternatively, other support structure(s), such as a series of cylindrical or otherwise shaped columns that couple the top and bottom surfaces of the unit, may be used. The unit 35 may also be coated or covered with various types of materials such as flocking, cotton, flannel, polyester, rayon, etc. The fourth unit 35 is independently inflatable with respect to the first inflatable mattress 20, the second inflatable mattress 40, and the bellows unit 50. The pump unit 60 as described above is adapted to include an additional port and hose that is coupled to the fourth unit 35 via fluid coupling means 36 to provide for independent inflation of the fourth unit 35. The control unit 62 as described above is adapted to provide for control over the inflation level of the fourth unit 35. The fourth unit 35 may be inflated to different pressure/comfort levels for support of the user's lumbar section independently of the pressure/comfort levels of the first and second inflatable mattresses 20, 40. The cover 65 as described above is adapted to substantially enclose the fourth unit 35.

Figure 5C:
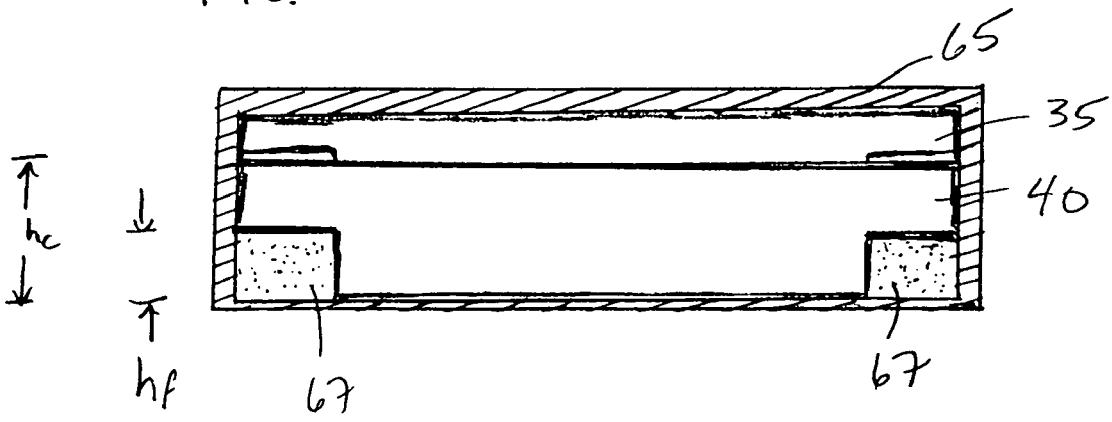
FIG. 5C is a schematic cross-sectional view of the multi-position air mattress system of FIG. 5A through line 5C-5C.

As shown in FIGS. 5A-5C, foam inserts 67 surround three sides of both the first inflatable mattress 20 and the second inflatable mattress 40. The foam inserts 67 may be held in place by straps. Alternatively, the foam inserts 67 may be housed in longitudinal enclosures, which may be permanent fastened or possibly removably fastened (e.g., by hook and loop fasteners) to the respective mattress. As best shown in FIGS. 5B and 5C, the height $h_f$ of the foam inserts 67 lies below the full height $h_c$ of the respective air mattress (mattress 20 or 40). This feature provides air support over 100 percent of the top surface of the air mattresses 20, 40, while providing adequate support at the perimeter where people sit down prior to laying down. The foam inserts 76 also aid against the user "bottoming out" when sitting on the edge of the air mattress system. Moreover, in the event that two smaller independent air mattresses are to be used together to make up a larger mattress, 100 percent of this larger mattress surface is air supported.

In the preferred embodiment, the fourth unit 35 is removably affixed to the second mattress 40 with hook or loop fastener strips 68A, 68B that are disposed on opposite sides of the second mattress 40 in the area adjacent the hinge 30 as shown in FIG. 5A. Hook or loop fastener strips (not shown) are also disposed opposite one another on the bottom side of the fourth unit 35 facing the fasteners strips 68A, 68B. In this configuration, the hook-and-loop fastener strips extend lengthwise along the top surface of the second mattress 40 to provide flexibility in positioning of the fourth unit 35 along its length in order to accommodate users with different body dimensions and needs. The hook-and-loop fastener strips are preferably heat sealed to the respective inflatable members 35, 40. Alternatively, the unit 35 can be permanently affixed to the second mattress 40.

K. Second Alternative Embodiment

Figure 6:
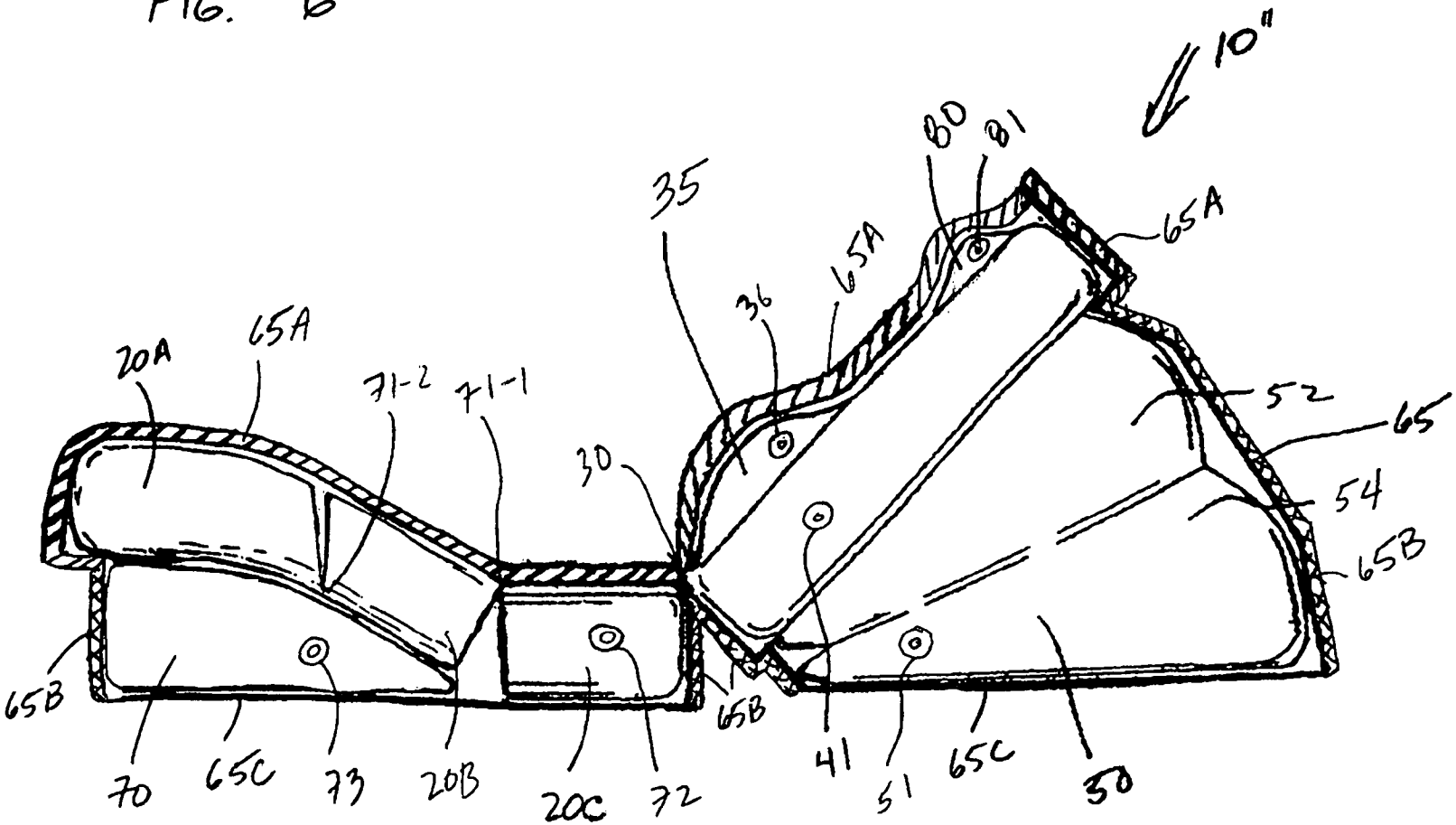
FIG. 6 is a cross-sectional view of yet another embodiment of a multi-position air mattress system in accordance with the present invention.

In yet another embodiment as shown in FIG. 6, the air mattress system 10" includes the second inflatable mattress 40, the bellows unit 50, and the fourth unit 35 as described above. The first mattress 20 is modified to include three sections: a front section 20A, a middle section 20B and back section 20C. The back section 20C is connected to the second mattress 40 via hinge 30. The middle section 20B is connected to the back section 20C by a second hinge 71-1. The front section 20C is connected to the middle section 20B by a third hinge 71-2. The three sections 20A, 20B, 20C are preferably fluidly interconnected to one another by non-valved flow paths (for example, flow paths that are part of the hinges 71-1 and 71-2) to allow for simultaneous or conditioned pressurization of the three sections 20A, 20B and 20C via fluid coupling means 72 from the pressurized air source. Alternatively, if desired, the three sections 20A, 20B, 20C can be inflated to different pressures. This feature may be controlled by a valved fluid coupling means (not shown) that fluidly couples the three sections 20A, 20B, 20C or by realizing the three sections 20A, 20B, 20C as three distinct air chambers that are pressurized independently from one another.

The front section 20A preferably includes foam inserts that surround its three sides (with the hinge side left open) in a manner similar to that described above with respect to FIGS. 5A and 5B. Likewise, the middle and back sections 20B, 20C preferably include foam inserts that surround their respective two sides (with the opposing hinged sides left open). An inflatable unit 70 is attached to the underside of the front and middle sections 20A, 20B and is disposed under the front and middle sections 20A, 20B as shown. The inflatable unit 70 may be comprised of one or more inflatable sections. The unit 70 is preferably comprised of reinforced PVC, reinforced rubber or other suitable material(s) capable of retaining pressurized air within. In addition, the unit 70 may have internal webs or beams that couple the top and bottom surfaces of the unit 70. Alternatively, other support structure(s), such as a series of cylindrical or otherwise shaped columns that couple the top and bottom surfaces of the unit 70, may be used. The unit 70 may also be coated or covered with various types of materials such as flocking, cotton, flannel, polyester, rayon, etc. When inflated, the unit 70 elevates the front and middle sections 20A, 20B to a desired position, thereby providing an elevated support surface for the user's legs relative to the buttocks and hips, which are supported by the back section 20C. The unit 70 receives pressurized air from the pressurized air source via fluid coupling means 73. The extent of inflation of the unit 70 is preferably controllable by the user. The inflation level of the unit 70, which is independent of the pressure levels of the mattress sections 20A, 20B, 20C and the second inflatable member 40, controls the elevation of the legs. Such elevation control provides relief for swelling of the legs as well as for circulatory ailments of the legs (e.g., varicose veins).

An inflatable unit 80 is affixed to the top side of the second mattress 40 and extends transverse to the lengthwise dimension of the mattress system to support the neck of the user's body. The unit 80 is preferably comprised of reinforced PVC, reinforced rubber or other suitable material(s) capable of retaining pressurized air within. In addition, the unit 80 may have internal webs or beams that couple the top and bottom surfaces of the unit 80. Alternatively, other support structure(s), such as a series of cylindrical or otherwise shaped columns that couple the top and bottom surfaces of the unit, may be used. The unit 80 may also be coated or covered with various types of materials such as flocking, cotton, flannel, polyester, rayon, etc. The unit 80 is independently inflatable with respect to the mattress sections 20A, 20B, 20C and the second inflatable mattress 40. The unit 80 receives pressurized air from the pressurized air source via fluid coupling means 81. The unit 80 may be inflated to different pressure/comfort levels for support of the user's neck independently of the pressure/comfort levels of the mattress sections 20A, 20B, 20C and second inflatable mattresses 20, 40. In the preferred embodiment, the neck support unit 80 is removably affixed to the second mattress 40 with hook or loop fastener means in a manner similar to that described above with respect to the lumbar support unit 35. In this configuration, the hook-and-loop fastener mechanism provides flexibility in positioning of the neck support unit 80 along its length in order to accommodate users with different body dimensions and needs. Alternatively, the neck support unit 80 can be permanently affixed to the second mattress 40.

The units 70 and 80 are independently inflatable with respect to the first mattress sections 20A, 20B, 20C the second inflatable mattress 40, the bellows unit 50, and the lumbar support member 35. The pump unit 60 as described above is adapted to include additional ports and hoses (FIG. 7) that are coupled to the unit 70 and unit 80 via fluid coupling means 73, 81, respectively, to provide for independent inflation of the unit 70 and the unit 80. The control unit 62 as described above is adapted to provide for control over the inflation level of the unit 70 and the unit 80. When the sections 20A, 20B, 20C are realized as distinct air chambers that are pressurized independently from one another, separate ports and hoses couple the unit 60 to the sections 20A, 20B, 20C to provide for independent inflation of the sections 20A, 20B, 20C.

The cover 65 as described above is adapted to substantially enclose the unit 70 and the unit 80. In the preferred embodiment, the cover 65 includes three portions 65A, 65B, and 65C as shown in FIG. 6. The first portion 65A overlies the top surfaces of the mattress sections 20A, 20B, 20C, the second mattress 40, the lumbar support unit 35 and neck support unit 80. The second portion 65B overlies the sides of the bellows unit 50 and the sides of the leg elevating unit 70. The third portion 65C overlies the bottom of the bellows unit 50 and the bottom of the leg elevating unit 70. The first portion 65A is preferably thick and plush to provide added comfort, and may incorporate fillings such as down feathers, latex foam, memory foam, cellulose, etc. The second portion 65B is preferably realized from an expandable material. Elastic straps may be provided to keep the material of the second cover portion 65B neat. The third cover portion 65C is preferably realized from a thin quilted material. The cover 65 may include one or more zippered or Velcro slots that allow the inflatable to be removed from within the cover 65. Finally, the cover 65 also preferably includes through-holes that provide access for coupling the hoses 61A, 61B, 61C, 61D, 61E (FIG. 7) to the respective members 20, 40, 50, 35, 70, 80.

The air mattress system of FIG. 6 has a number of important features and benefits, including:

- in the prone bed position, the pressure/comfort levels of the first mattress 20 and the second mattress 40 are controlled independently;
- the lumbar support unit 35 may be inflated to different pressure/comfort levels independently and in conjunction with the pressure/comfort levels of the first mattress 20 and the second mattress 40;
- the leg elevation unit 70 may be inflated independently for relief of leg swelling or circulatory ailments (e.g., varicose veins) regardless of the pressure/comfort levels of the first mattress 20 and the second mattress 40;
- the bellows unit 50 may be inflated independently in order to control the inclination angle of the body; and
- the entire (100%) mattress structure is air supported while providing a foam perimeter that aids against a user "bottoming out" when sitting on the edge of the mattress.

L. Large Air Mattress Arrangement

Figure 7:
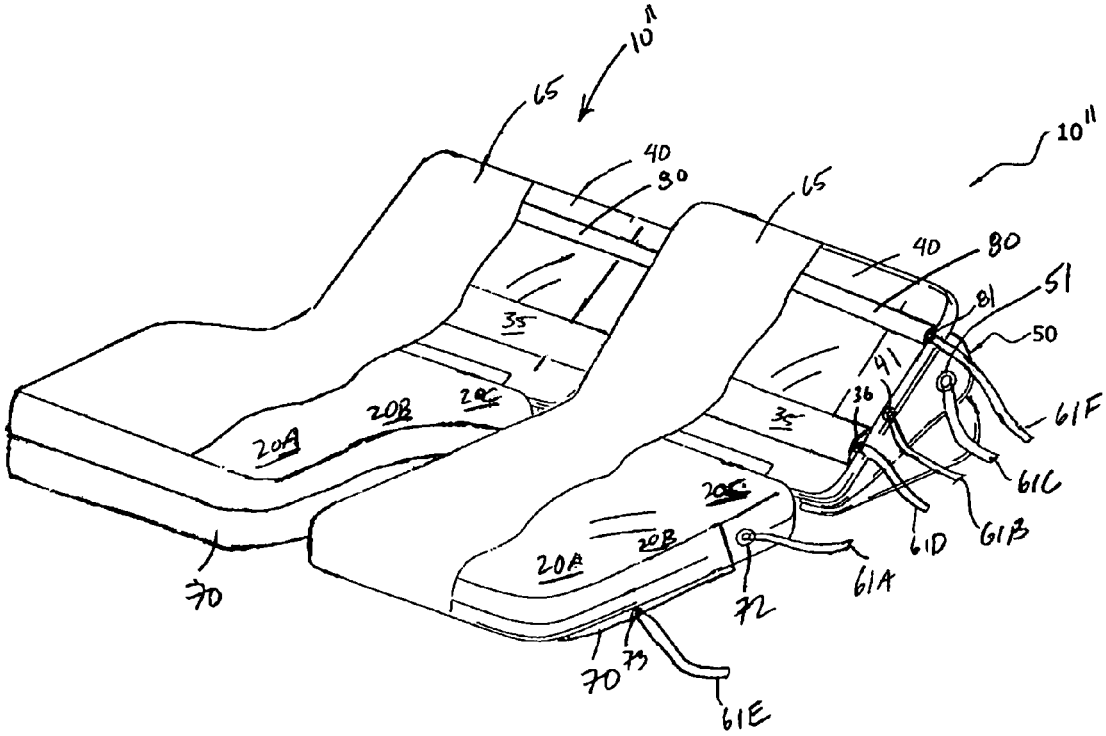
FIG. 7 is a perspective partial cut-away view of a large air mattress structure in accordance with the present invention, which is realized by placing two multi-position air mattress systems of FIG. 6 is a side-by-side configuration.

In another embodiment shown in FIG. 7, two air mattress systems as described above with respect to FIG. 6 are arranged in a side-by-side manner to provide a large air mattress structure (e.g., queen or king size arrangement). In this configuration, the inflation levels of each particular side are independently controllable in accordance with the desired pressure/comfort levels and positioning (e.g., degree of upper body inclination and leg elevation) of the user of the particular side. In the example shown, the bellows unit 50 of each system is inflated such that system is positioned in the inclined bed position. The near-side system is inclined at a greater angle as compared to the far-side system. In addition, the unit 70 of the near-side system is deflated, while the unit 70 of the far-side system is inflated to provide for elevation of the legs of the near-side user. The other inflatable members of the two systems are independently inflated to provide the desired support/comfort levels for the two users. The hoses and control unit that are coupled to the far-side system are not shown for simplicity of description, but are similar to those shown for the near-side system.

The air mattress system of FIG. 7 has a number of important features and benefits, including:

- in the prone bed position, each of the users has independent upper and lower body comfort control;
- each of the users has independent inclination control without disturbing the other user;

each of the users has independent control over the pressure/comfort level of the lumbar support unit 35 without disturbing the other user;

each of the users has independent leg elevation control without disturbing the other user; and all of these uses, adjustments and functions can be performed independently from one another for a given user and independent of the same for the other user.

While specific materials, shapes, forms, functions and manners of operation, assembly and use have been provided, it will be recognized by those skilled in the art that they may be varied, and all equivalent structural variations and relationships to those illustrated in the drawings and described in the specification are intended to be encompassed by the present invention. Any headings utilized within the description are for convenience only and have no legal or limiting effect. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multiple position air mattress system, comprising:

a first inflatable member;

a second inflatable member;

a hinge pivotally connecting said second inflatable member and said first inflatable member; and a third inflatable member attached to said second inflatable member wherein said third inflatable member can assume a position with said third inflatable member below said second inflatable member; and at least one of first foam supporting means that surrounds at least three sides of said first inflatable member and second foam supporting means that surrounds at least three sides of said second inflatable member;

wherein the inflation level of said third inflatable member is adaptable such that:

i) when substantially deflated, said air mattress system is positioned in a prone bed position, and ii) when inflated, said second inflatable member pivots relative to said first inflatable member and the air mattress system is positioned in an inclined bed position.

2. A multiple position air mattress according to claim 1, wherein:

said hinge is located adjacent the top surfaces of said first and second inflatable members.

3. A multiple position air mattress according to claim 1, wherein:

said first, second and third inflatable members are independently inflatable.

4. A multiple position air mattress system according to claim 3, further comprising:

a pump unit for inflating said first, second and third inflatable members.

5. A multiple position air mattress system according to claim 4, wherein:

said pump unit comprises a plurality of ports corresponding to said first, second and third inflatable members and a corresponding plurality of fluid coupling means between said ports and the respective first, second and third inflatable members.

6. A multiple position air mattress system according to claim 4, further comprising:

a control unit, operably coupled to said pump unit, for independently controlling inflation levels of said first, second and third inflatable members.

7. A multiple position air mattress system according to claim 1, further comprising:

a cover that substantially encloses the first, second and third inflatable members, wherein said cover comprises a plush top surface.

8. A multiple position air mattress system according to claim 1, further comprising:

a cover that substantially encloses the first, second and third inflatable members, wherein said cover includes through-holes that provide access for hoses that are coupled to the first, second and third inflatable members.

9. A multiple position air mattress system according to claim 1, further comprising:

a lumbar supporting inflatable member, affixed atop said second inflatable member, for providing support of the lumbar section of the user's body, said lumbar supporting inflatable member independently inflatable with respect to said first, second and third inflatable members.

10. A multiple position air mattress system according to claim 9, wherein:

said lumbar supporting inflatable member is removably attached atop said second inflatable member.

11. A multiple position air mattress system according to claim 10, wherein:

said lumbar supporting inflatable member is adjustably positioned atop said second inflatable member.

12. A multiple position air mattress system according to claim 1, wherein:

height of said first foam supporting means is less than full height of said first inflatable member.

13. A multiple position air mattress system according to claim 1, wherein:

height of said second foam supporting means is less than full height of said second inflatable member.

14. A multiple position air mattress system according to claim 9, wherein:

said first inflatable member includes a plurality of sections that are pivotally connected by at least one hinge interface, at least one of said sections supporting the legs of the user;

a leg supporting inflatable member disposed under the at least one section supporting the legs of the user;

wherein the inflation level of said leg supporting inflatable member is adaptable to selectively elevate the position of the legs of the user.

15. A multiple position air mattress system according to claim 14, wherein:

the plurality of sections of said first inflatable members are fluidly coupled by non-valved flow paths for simultaneous inflation and deflation.

16. A multiple position air mattress system according to claim 1, wherein:

air support is provided by 100 percent of the top surface of the air mattresses system.

17. A multiple position air mattress system according to claim 1, further comprising:

a neck supporting inflatable member, affixed atop said second inflatable member, for providing support of the neck of user's body, said neck supporting inflatable member independently inflatable with respect to said first, second and third inflatable members.

18. A multiple position air mattress system according to claim 17, wherein:

said neck supporting inflatable member is removably attached atop said second inflatable member.

19. A multiple position air mattress system according to claim 17, wherein:

said neck supporting inflatable member is adjustably positioned atop said second inflatable member.

20. A multiple position air mattress system, comprising:

a first inflatable member;

a second inflatable member;

a hinge pivotally connecting said second inflatable member and said first inflatable member; and a third inflatable member attached to said second inflatable member wherein said third inflatable member can assume a position with said third inflatable member below said second inflatable member; and at least one elongate inflatable member affixed atop said second inflatable member and in the inflated state extending above the body support surface provided by said second inflatable member, said at least one elongate inflatable member selected from the group consisting of a lumbar support member and a neck support member, said lumbar support member for providing support of the lumbar section of the user's body and being independently inflatable with respect to said first, second and third inflatable members, said neck support member for providing support of the neck of user's body and being independently inflatable with respect to said first, second and third inflatable members;

wherein the inflation level of said third inflatable member is adaptable such that:

i) when substantially deflated, said air mattress system is positioned in a prone bed position, and ii) when inflated, said second inflatable member pivots relative to said first inflatable member and the air mattress system is positioned in an inclined bed position.

21. A multiple position air mattress according to claim 20, wherein:

said hinge is located adjacent the top surfaces of said first and second inflatable members.

22. A multiple position air mattress system according to claim 20, further comprising:

a pump unit for inflating said first, second, third and at least one elongate inflatable members, said pump unit including a plurality of ports corresponding to said first, second, third and at least one elongate inflatable members and a corresponding plurality of fluid coupling means between said ports and the respective first, second, third and at least one elongate inflatable members; and a control unit, operably coupled to said pump unit, for independently controlling inflation levels of said first, second, third and at least one elongate inflatable members.

23. A multiple position air mattress system according to claim 20, further comprising:

a cover that substantially encloses the first, second, third and at least one elongate inflatable members.

24. A multiple position air mattress system according to claim 23, wherein:

said cover comprises a plush top surface.

25. A multiple position air mattress system according to claim 23, wherein:

said cover includes through-holes that provide access for hoses that are coupled to the first, second, third and at least one elongate inflatable members.

26. A multiple position air mattress system according to claim 20, wherein:

said at least one elongate inflatable member includes said lumbar support member.

27. A multiple position air mattress system according to claim 26, wherein:

said lumbar support member is removably attached atop said second inflatable member.

28. A multiple position air mattress system according to claim 26, wherein:

said lumbar support member is adjustably positioned atop said second inflatable member.

29. A multiple position air mattress system according to claim 20, further comprising:

at least one of first foam supporting means that surrounds at least three sides of said first inflatable member and second foam supporting means that surrounds at least three sides of said second inflatable member.

30. A multiple position air mattress system according to claim 29, wherein:

height of said first foam supporting means is less than full height of said first inflatable member.

31. A multiple position air mattress system according to claim 29, wherein:

height of said second foam supporting means is less than full height of said second inflatable member.

32. A multiple position air mattress system according to claim 26, wherein:

said first inflatable member includes a plurality of sections that are pivotally connected by at least one hinge interface, at least one of said sections supporting the legs of the user; and a leg supporting inflatable member is disposed under the at least one section supporting the legs of the user, wherein the inflation level of said leg supporting inflatable member is adaptable to selectively elevate the position of the legs of the user.

33. A multiple position air mattress system according to claim 32, wherein:

the plurality of sections of said first inflatable members are fluidly coupled by non-valved flow paths for simultaneous inflation and deflation.

34. A multiple position air mattress system according to claim 20, wherein:

air support is provided by 100 percent of the top surface of the air mattresses system.

35. A multiple position air mattress system according to claim 20, wherein:

said at least one elongate inflatable member includes said neck support member.

36. A multiple position air mattress system according to claim 35, wherein:

said neck support member is removably attached atop said second inflatable member.

37. A multiple position air mattress system according to claim 35, wherein:

said neck support is adjustably positioned atop said second inflatable member.

38. A method of supporting the body of a user on a support surface comprising:

providing at least one air mattress system having a first inflatable member, a second inflatable member pivotally attached to said first inflatable member, a third inflatable member attached to said second inflatable member, at least one elongate inflatable member affixed atop said second inflatable member and in the inflated state extending above the body support surface provided by said second inflatable member, said at least one elongate inflatable member selected from the group consisting of a lumbar support member and a neck support member, said lumbar support member for providing support of the lumbar section of the user's body and being independently inflatable with respect to said first, second and third inflatable members, said neck support member for providing support of the neck of user's body and being independently inflatable with respect to said first, second and third inflatable members, a pump unit for inflating said first, second, third and at least one elongate inflatable members, said pump unit including a plurality of ports corresponding to said first, second, third and at least one elongate inflatable members and a corresponding plurality of fluid coupling means between said ports and the respective first, second, third and at least one elongate inflatable members, and a control unit, operably coupled to said pump unit, for independently controlling inflation levels of said first, second, third and at least one elongate inflatable members, wherein position of said air mattress system is adjustable between any one of a plurality of user selected positions including a prone bed position and an inclined bed position;

positioning said first, second and third inflatable members such that said first and third inflatable members rest on said support surface and said second inflatable member rests atop said third inflatable member;

interacting with said control unit to operate said pump unit to inflate said first and second inflatable members; and interacting with said control unit to operate said pump unit to control an inflation level of said third inflatable member, wherein said third inflatable member is substantially deflated if said user selected position is said prone bed position, and wherein said third inflatable member is inflated to cause said second inflatable member to pivot relative to said first inflatable member if said user selected position is said inclined bed position.

39. The method according to claim 38, further comprising:

substantially enclosing the first, second, third and at least one elongate inflatable members in a cover.

40. The method according to claim 38, wherein:

said at least one elongate inflatable member includes said lumbar support member and the control unit operates said pump unit to inflate said lumbar support member.

41. The method according to claim 38, further comprising:

providing said air mattress system with said first inflatable member including a plurality of sections that are pivotally connected by a hinge interface, at least one of said sections supporting the legs of the user, a leg supporting inflatable member disposed under the at least one section supporting the legs of the user, wherein the inflation level of said leg supporting inflatable member is adaptable to selectively elevate the position of the legs of the user, said pump unit with a port and fluid coupling means between said port and said leg supporting inflatable member, and said control unit adapted to independently control inflation levels of said leg supporting inflatable member; and interacting with said a control unit to operate said pump unit to inflate said leg supporting inflatable member.

42. The method according to claim 38, wherein:

said at least one elongate inflatable member includes said neck support member and the control unit operates said pump unit to inflate said neck support member.

43. A method according to claim 38, wherein:

said at least one air mattress system comprises two like air mattress systems that are arranged in a side-by-side configuration to provide a larger air mattress structure.

* * * * *